US007380607B2

(12) United States Patent
Thomas

(10) Patent No.: US 7,380,607 B2
(45) Date of Patent: Jun. 3, 2008

(54) CASING HANGER WITH INTEGRAL LOAD RING

(75) Inventor: Sean P. Thomas, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 92 days.

(21) Appl. No.: 11/153,302

(22) Filed: Jun. 15, 2005

(65) Prior Publication Data

US 2005/0274526 A1 Dec. 15, 2005

Related U.S. Application Data

(60) Provisional application No. 60/579,629, filed on Jun. 15, 2004.

(51) Int. Cl.
*E21B 29/12* (2006.01)

(52) U.S. Cl. ..... 166/348; 166/368; 166/208

(58) Field of Classification Search ..... 166/348, 166/368, 382, 208, 211
See application file for complete search history.

(56) References Cited

U.S. PATENT DOCUMENTS

| | | | | |
|---|---|---|---|---|
| 2,849,245 | A * | 8/1958 | Baker | 285/123.6 |
| 4,528,738 | A * | 7/1985 | Galle, Jr. | 29/416 |
| 4,641,708 | A * | 2/1987 | Wightman | 166/208 |
| 4,665,979 | A * | 5/1987 | Boehm, Jr. | 166/208 |
| 4,773,477 | A * | 9/1988 | Putch | 166/206 |
| 4,836,579 | A * | 6/1989 | Wester et al. | 285/3 |
| 4,909,546 | A * | 3/1990 | Nobileau | 285/123.4 |
| 4,989,902 | A * | 2/1991 | Putch | 285/18 |
| 5,160,172 | A * | 11/1992 | Gariepy | 285/18 |
| 5,226,478 | A * | 7/1993 | Henderson et al. | 166/285 |
| 5,240,076 | A * | 8/1993 | Cromar et al. | 166/382 |
| 5,249,629 | A * | 10/1993 | Jennings | 166/348 |
| 5,421,407 | A * | 6/1995 | Thornburrow | 166/85.3 |
| 5,638,903 | A * | 6/1997 | Kent | 166/348 |
| 5,839,512 | A * | 11/1998 | Malone et al. | 166/348 |
| 6,012,519 | A * | 1/2000 | Allen et al. | 166/75.14 |
| 2005/0051337 | A1* | 3/2005 | Jennings et al. | 166/348 |
| 2006/0016604 | A1* | 1/2006 | Ford | 166/348 |

* cited by examiner

*Primary Examiner*—Thomas A Beach
(74) *Attorney, Agent, or Firm*—Bracewell & Giuliani

(57) ABSTRACT

A subsea wellhead assembly includes a housing with a bore containing at least one conical generally upward facing load shoulder that inclines relative to an axis of the bore. A hanger is lowered into the housing, the hanger having at least one conical downward facing load shoulder that inclines at a lesser inclination relative to an axis of the bore than the upward facing load shoulder. A split load ring has an inner profile that slidingly engages the downward facing load shoulder and an outer profile that slidingly engages the upward facing load shoulder. The load ring is carried by the hanger for movement between a retracted position, wherein the outer profile is spaced radially inward from the upward facing load shoulder, and an expanded position wherein the outer profile is in engagement with the upward facing load shoulder.

19 Claims, 5 Drawing Sheets

CASING HANGER WITH INTEGRAL LOAD RING

CROSS-REFERENCE TO RELATED APPLICATION

This application claims priority to provisional application 60/579,629, filed Jun. 15, 2004.

FIELD OF THE INVENTION

This invention relates in general to wellhead equipment for oil and gas wells, and in particular to a casing hanger full bore load ring mechanism.

BACKGROUND OF THE INVENTION

A typical subsea wellhead assembly includes a wellhead housing that supports one or more casing hangers. One type of wellhead housing has a conical load shoulder machined within its bore. The casing hanger lands on and is supported by the load shoulder. In this type, the diameter of the housing bore below the bore is less than the diameter of the housing above the bore by a dimension equal to a radial width of the load shoulder.

In another type, referred to as "full bore", the wellhead housing has a groove with substantially the same diameter above and below the groove. The load shoulder is a split ring that is installed subsequently in the groove. The casing hanger is supported by the load shoulder. This procedure allows a larger diameter bore to be employed during drilling operations. The load shoulder may be installed on a special running tool or it may be run with the casing hanger.

SUMMARY OF THE INVENTION

In this invention, the wellhead housing has a bore containing at least one conical generally upward facing load shoulder that inclines relative to an axis of the bore. A casing hanger is landed in the housing. The hanger has at least one conical downward facing load shoulder that inclines at a lesser inclination relative to an axis of the bore than the upward facing load shoulder. A split load ring is carried by the hanger for supporting the hanger on the upward facing load shoulder. The load ring has an inner profile that slidingly engages the downward facing load shoulder of the hanger and an outer profile that slidingly engages the upward facing load shoulder of the housing. The load ring is carried by the hanger for movement between a retracted position, wherein the outer profile is spaced radially inward from the upward facing load shoulder, and an expanded position wherein the outer profile is in engagement with the upward facing load shoulder.

DETAILED DESCRIPTION OF THE INVENTION

Figure 1:
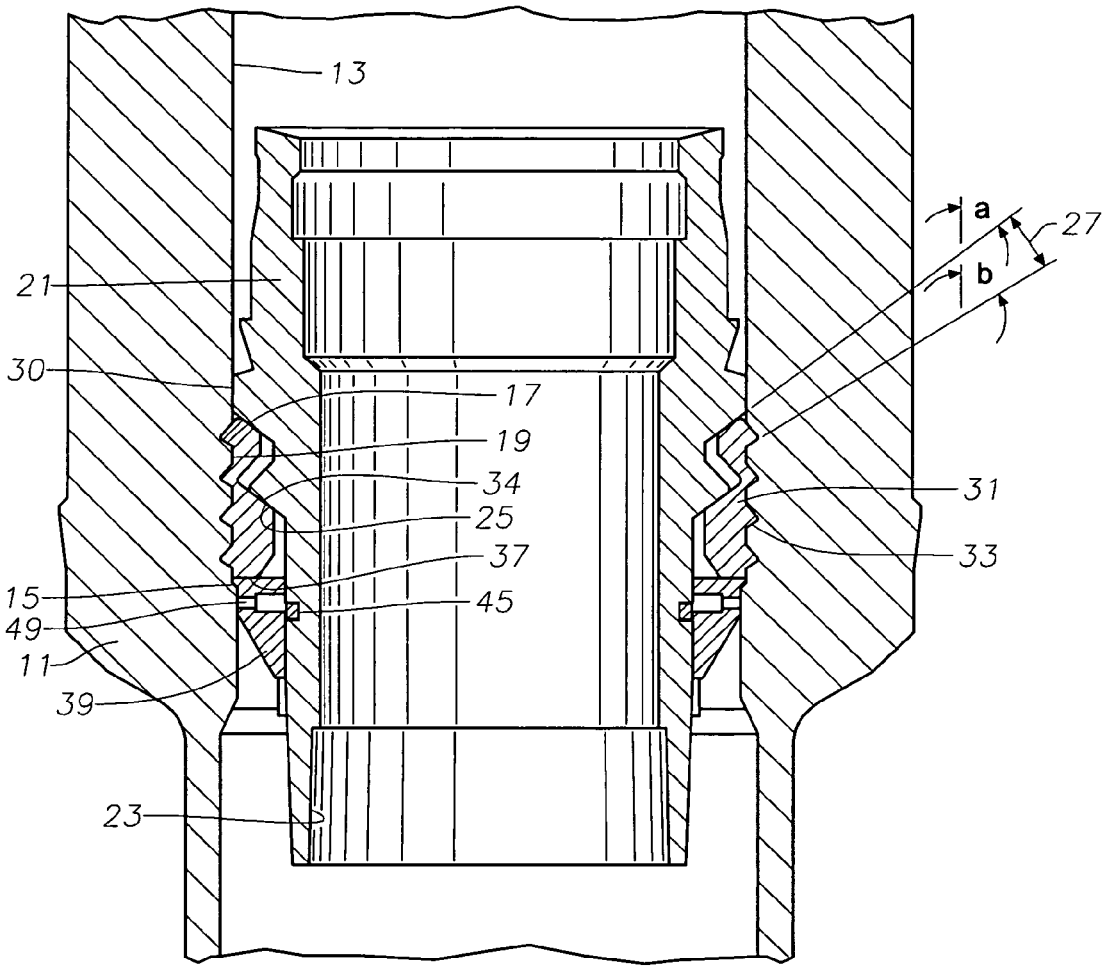
FIG. 1 is a vertical sectional view of a casing hanger and load ring shown in the set position within a wellhead housing and constructed in accordance with this invention.

Referring to FIG. 1, wellhead housing 11 is normally located at the upper end of a well at the sea floor and has an axial bore 13. Bore 13 has a tag shoulder 15 located within it. Tag shoulder 15 is a circular ledge located at a junction between a larger diameter upper portion in bore 13 and a slightly smaller diameter lower portion of bore 13.

An internal grooved profile, formed in bore 13 above tag shoulder 15, comprises a plurality of load shoulders 17, each facing generally upward and inward, resulting in a generally saw-tooth configuration. A cylindrical stop space 19 is located between each load shoulder 17. Each stop spaces 19 is approximately the same axial length as one of the grooves that define one of the load shoulders 17.

A casing hanger 21 lands within wellhead housing 11. Casing hanger 21 has a lower threaded end 23 for securing to a string of casing (not shown) that extends into and is cemented in the well. Casing hanger 21 has a profile made up of a plurality of load shoulders 25, which preferably are fewer than wellhead housing shoulders 17. In this embodiment, there are two casing hanger load shoulders 25 and four wellhead housing load shoulders 17. The number of load shoulders 17, 25 can vary. In the preferred embodiment, each casing hanger load shoulder 25 has a greater radial depth and axial dimension than each wellhead housing load shoulder 17. Hanger load shoulders 25 preferably face downward and outward at a different angle than the upward and inward facing wellhead housing load shoulders 17. Preferably, the angle a relative to a vertical axis of hanger load shoulders 25 is less than an angle b of wellhead housing load shoulders 17 to a vertical axis, thus hanger load shoulders 25 are steeper. This results in a difference in angles indicated by the numeral 27 on the right side of FIG. 1. In one embodiment, angle a is approximately 55 degrees and angle b is approximately 60 degrees, resulting an angle difference 27 being 5 degrees.

Figure 4:
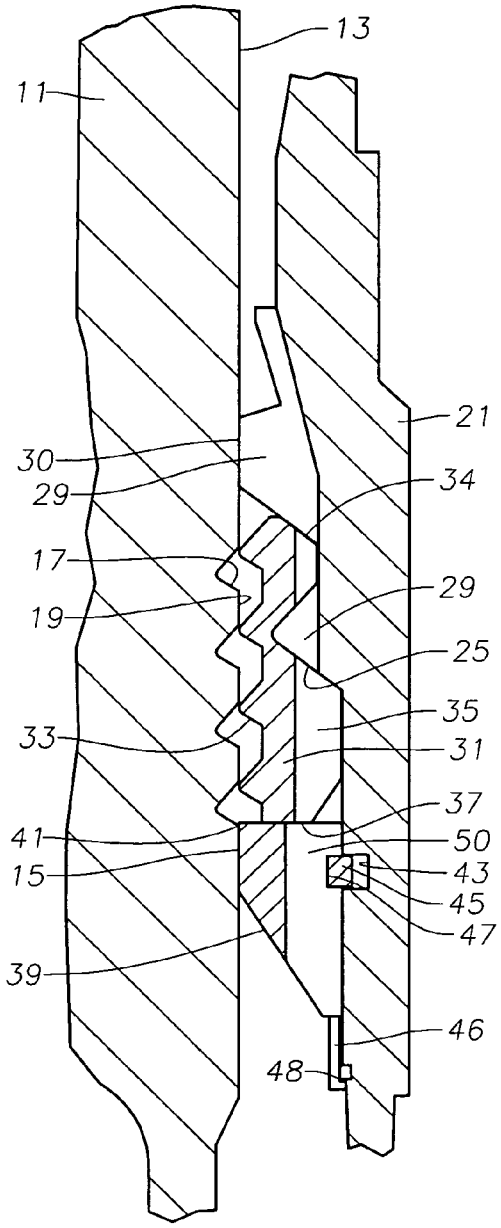
FIG. 4 is a view similar to FIG. 2, but taken along a different section plane to illustrate the flowby slots.

Referring briefly to FIG. 4, hanger 21 also has a plurality of vertical flowby slots 29 to allow the upward flow of cement returns during the cementing of the casing. Flowby slots 29 extend through hanger load shoulders 25. An enlarged portion 30 of hanger 21 directly above load shoulders 25 has a diameter only slightly less than the inner diameter of bore 13, and flowby slots 29 extend through this portion as well.

Figure 2:
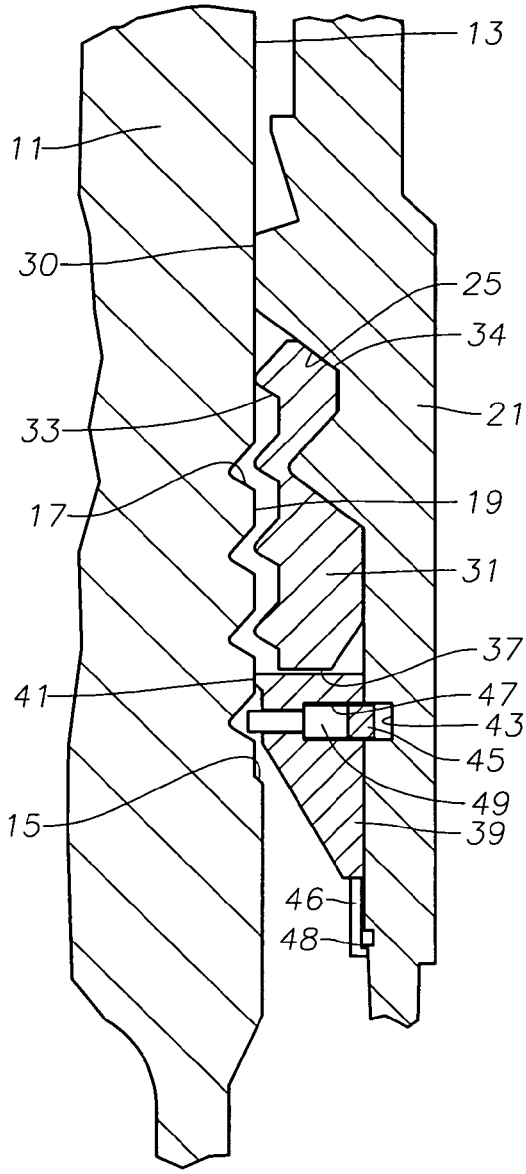
FIG. 2 is an enlarged quarter sectional view of the casing hanger of FIG. 1, shown prior to setting.
Figure 5:
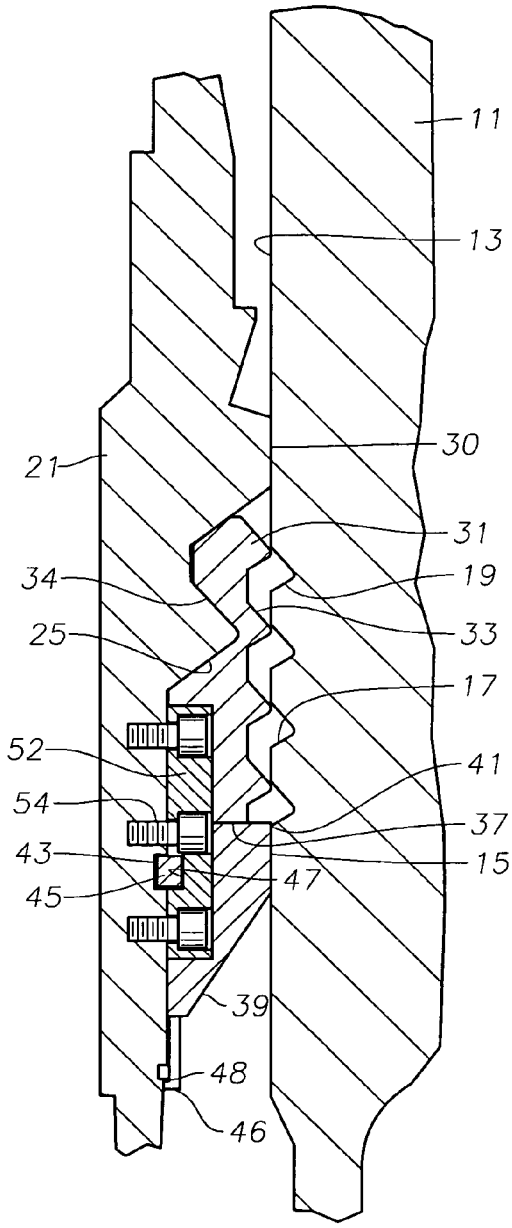
FIG. 5 is an enlarged sectional view of the right half of the casing hanger of FIG. 1, but shown prior to setting and along a different sectional plane to illustrate the anti-rotation key.

Referring again to FIG. 1, a split load ring 31 is movably mounted on hanger 21 to support hanger 21 on wellhead housing load shoulder 17. Load ring 31 is resiliently biased inwardly, so that prior to landing, as shown in FIGS. 2, 4 and 5, its natural resiliency will cause it to remain retracted. Load ring 31 has a plurality of external load shoulders 33 for mating with wellhead housing load shoulders 17. Load ring 31 has internal shoulders 34 for mating with hanger load shoulders 25. Internal load shoulders 34 face upward and inward at the same angle as hanger load shoulders 25. Load ring external shoulders 33 face downward and outward at the same angle as wellhead housing load shoulders 17.

The angles of external load ring shoulders 33 differ from internal load ring shoulders 34. Differential angle 27 is selected to just overcome the resistance created by frictional effects occurring when load ring 31 moves from the retracted position of FIGS. 2, 4 and 5 to the set position of FIGS. 1 and 3. The cylindrical stop spaces 19 between wellhead housing load shoulders 17 are contacted by mating portions of load ring 31 during setting to prevent load ring 31 from traveling radially outward farther than the desired amount. Mating cylindrical surfaces on load ring 31 between external shoulders 33 will contact stop spaces 19 to create a positive radial outward stop.

Referring briefly again to FIG. 4, load ring 33 has a plurality of flowby slots 35 in its interior that align with flowby slots 29 in hanger 21. Flowby slots 35 are located radially inward from external load shoulders 33. Slots 29 and 35 combine to create flow channels for cement returns. Preferably, the lower end 37 of load ring 31 is perpendicular to the axis of wellhead housing 11.

Figure 3:
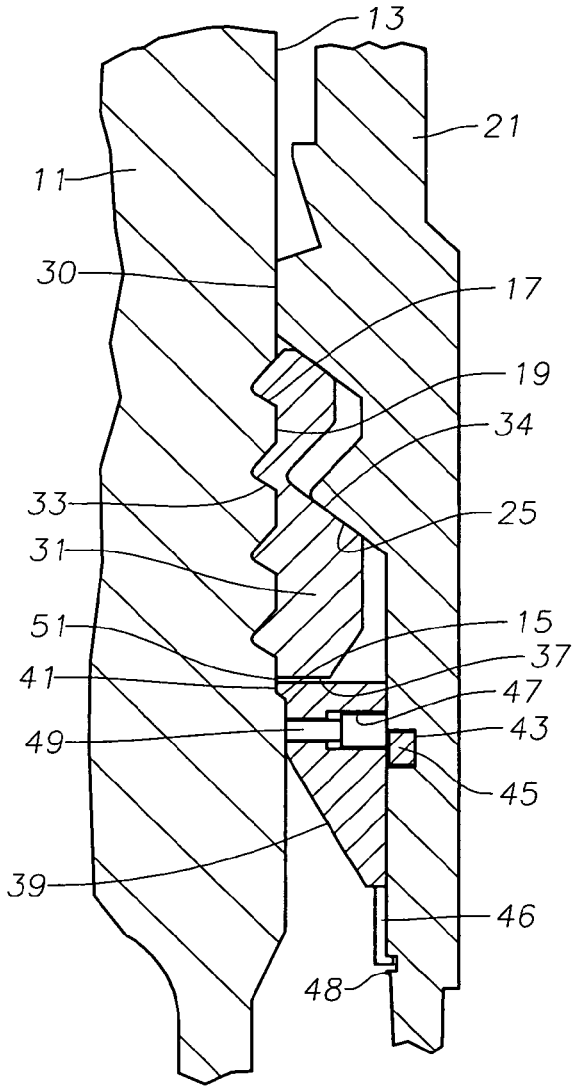
FIG. 3 is an enlarged quarter sectional view of the casing hanger of FIG. 1, shown after setting.

Referring to FIGS. 2 and 3, an activation ring 39 serves to cause load ring 31 to move from the retracted position of FIG. 2 to the set position of FIG. 3. Activation ring 39 is a non-expandable ring that is axially movable relative to hanger 21. Activation ring 39 has a tag shoulder 41 that is dimensioned to land on tag shoulder 15 in wellhead housing bore 13. Hanger 21 has an annular recess 43 on its outer diameter that is radially inward of activation ring 39. A split latch ring 45 with an outward bias is carried in hanger annular recess 43. Activation ring 39 has a mating annular recess 47 on its inner diameter that aligns with annular recess 43 during the running position. Latch ring 45 is dimensioned to be partly in activation ring recess 47 and partly in hanger recess 43 in the running position as shown in FIG. 2. This position prevents activation ring 39 from any axial movement relative to hanger 21.

In this embodiment, a plurality of trigger pins 49 extend radially from activation ring recess 47 to the outer diameter of activation ring 39. The outer ends of each pin 49 protrudes slightly past the outer diameter of activation ring 39 just below tag shoulder 41. A head or inner end of each trigger pin 49 contacts the outer diameter of latch ring 45. Trigger pins 41 keep latch ring 45 within the mating recesses 43 until activation ring tag shoulder 41 lands on tag shoulder 15, then cause latch ring 45 to move out of engagement with annular recess 47.

Referring to FIGS. 2 and 3, a thin-walled ring 46 extends downward from activation ring 39. Ring 46 has a rib on its inside diameter that fits tightly to the outer diameter of hanger 21. A small annular detent rib 48 is formed on the outer diameter of hanger 21 for engagement by the rib on ring 46. In the running position of FIG. 2, rib 48 is located above the rib of ring 46. In the set position of FIG. 3, rib 48 is located below the rib of ring 46.

Referring to FIG. 4, a plurality of flowby slots 50 extend axially through activation ring 39. Each flowby slot 50 is vertically aligned with flowby slots 35 and 29. As shown in FIG. 4, an anti-rotation key 52 is employed to make sure that flowby slots 35, 29 and 50 remain in vertical alignment with each other. Key 52 locates within mating recesses formed on hanger 21, in activation ring 39, and in load ring 31. Fasteners 54 secure key 52 in this position to prevent any rotation of activation ring 39 or load ring 31 relative to hanger 21.

In the running operation of hanger 21, load ring 31 will be in the retracted position shown in FIG. 2. The outer diameter of load ring 31 in this position is no greater than the outer diameter of hanger 21 at enlarged diameter portion 30. The resiliency of load ring 31 biases it to the retracted position and keeps load ring 31 from moving radially outward from the position shown in FIG. 2 while running in. The rib on thin-walled ring 46 will be located below rib 48. As hanger 21 enters bore 13, tag shoulder 41 (FIG. 2) will land on wellhead housing tag shoulder 15. The outer ends of trigger pins 49 will contact bore 13 below tag shoulder 15 and move radially inward, pushing latch ring 45 to a retracted position. In the retracted position, latch ring 45 locates wholly within hanger recess 43, releasing hanger 21 for downward movement relative to activation ring 39. As hanger 21 continues to move downward, activation ring 39 contacts the lower end of load ring 31, effectively pushing load ring 31 up hanger 21, which moves load ring 31 radially outward into housing load shoulders 17, as shown in FIG. 3. Also, at the same time the weight on hanger 31 causes rib 48 to snap past the rib on ring 46 and move below to the position of FIG. 3.

As hanger 21 moves downward relative to load ring 31, hanger load shoulders 25 exert a downward and outward force normal to load shoulders 25. At the same time, wellhead housing load shoulders 17 provide an upward and inward reactive force normal to load shoulder 17. These forces are not directly opposed because of the different angles of load shoulders 17, 25. The reactive force from shoulders 17 is not directed as much radially inward as the downward force from shoulders 25 is directed radially outward, thus resulting in a net outward directed force being applied to load ring 31. The frictional effects between load ring 31 and load shoulders 17, 25 tend to retard the radial outward movement of load ring 31, thus the net outward force due to the difference 27 in angles is calculated to be somewhat more than the opposed frictional force. Steeper angles for load shoulders 17 and 25 would provide more outward net force to load ring 31 during setting, but would reduce the axial load capacity.

Once fully engaged, a small axial clearance 51 (FIG. 3) will exist between the upper end of activation ring 39 and lower end 37 of load ring 31. Downward load on hanger 21 transfers from hanger load shoulders 25 through load ring 31 to wellhead housing load shoulders 17. Clearance 51 avoids any downward load being transferred to wellhead housing tag shoulder 15.

Slacking off the weight in running string will indicate that load ring 31 has set. As a further assurance, the operator can apply a selected overpull. The casing and hanger 21 will move upward slightly relative to activation ring 39 and load ring 31until rib 48 contacts the rib on ring 46. A selected overpull, say 200,00 pounds, will be necessary to cause rib 48 to snap past the rib of ring 46, thus the operator will pull upward a fraction of that amount, such as 100,000 pounds, to determine if rib 48 is pushing against the rib on ring 46. If so, this indicates that load ring 31 has properly set. The operator can then slack off the weight.

The angular difference 27 (FIG. 1) between load shoulders 17 and 25 assures that load ring 31 reaches the full radially engaged position wherein it engages stop spaces 19 between load shoulders 17 of wellhead housing 11. During cementing, fluid flowing up the annulus surrounding the casing flows up flowby slots 50, 35 and 29 (FIG. 4).

Figure 6:
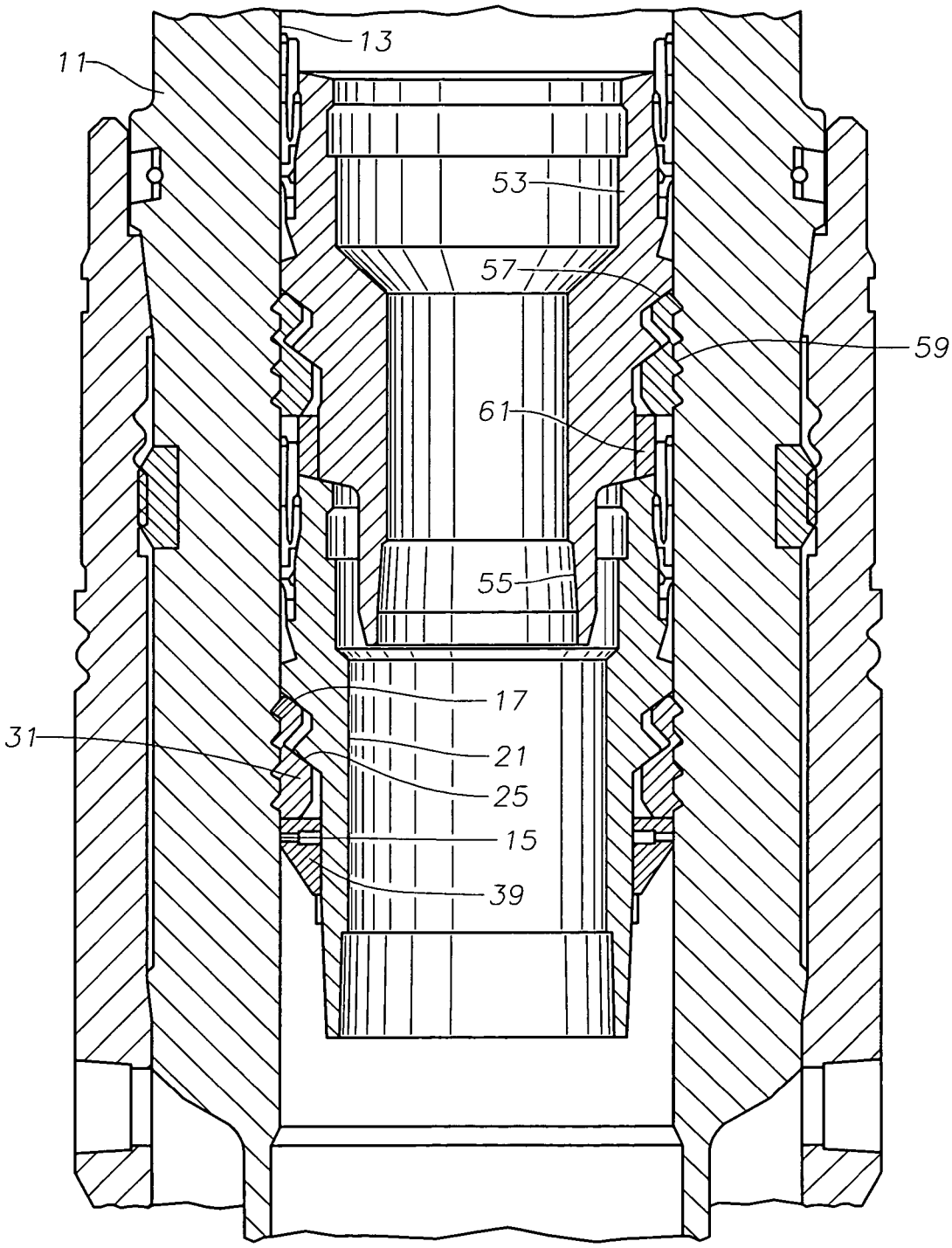
FIG. 6 is a vertical sectional view of the casing hanger and wellhead of FIG. 1, showing an additional casing hanger landed on the casing hanger of FIG. 1.

Referring to FIG. 6, an additional upper casing hanger 53 may land on casing hanger 21 to support a smaller diameter string of casing (not shown). Upper hanger 53 has a threaded end 55 for securing to the smaller diameter casing. Upper hanger 53 also has a movable load ring 57 that may be constructed the same as load ring 31. Wellhead housing 11 has an upper profile of load shoulders 59 that may be configured the same as load shoulders 17. In this embodiment, a tag shoulder similar to tag shoulder 15 is not needed because the assembly of upper hanger 53 lands on lower hanger 21.

An activation ring 61 is mounted to the lower end of upper hanger 53. Activation ring 61 may be secured to upper hanger 53 by shear pins (not shown) that initially pin activation ring 61 to upper hanger 53 in a running position. When activation ring 61 lands on the upper end of lower hanger 21, the weight of the running string applied to upper hanger 53 shears the pins and causes upper hanger 53 to move downward relative to activation ring 61 and load ring 57.

Figure 7:
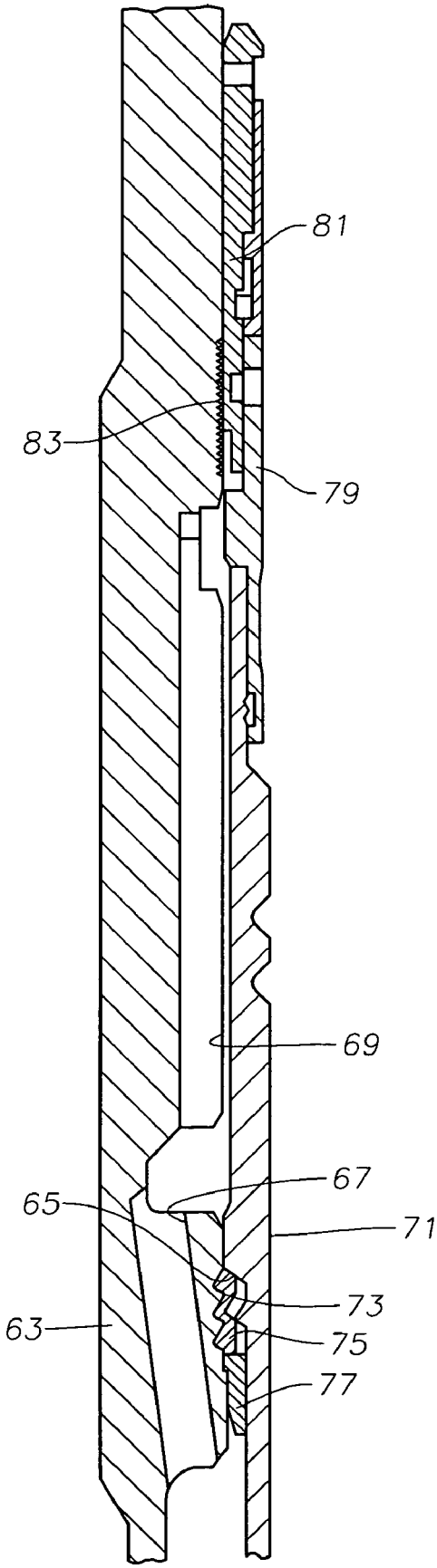
FIG. 7 is a quarter sectional view of an alternate embodiment of a casing hanger and load ring constructed in accordance with this invention.

A mudline hanger assembly is shown in the embodiment of FIG. 7. A housing 63 at the sea floor extends upward from the well. Housing 63 has a plurality of load shoulders 65 configured generally as in the first embodiment. Flowby passages 67, 69 are formed in the wall of housing 63. A hanger 71, located at the upper end of a string of casing (not shown), lands in housing 63. Hanger 71 has a load ring 73 constructed generally as in the first embodiment, except that it does not have flowby slots because all of the cement returns are handled by flowby passages 67, 69. In this embodiment, hanger 71 has two load shoulders 75, and housing 63 has three load shoulders 65, but the number could vary. The angles of load shoulders 75 and 65 preferably differ as in the first embodiment.

An activation ring 77 may be secured to hanger 71 by trigger pins as in the first embodiment. This embodiment could also use the detent rib and collet finger arrangement of the first embodiment, if desired. Activation ring 77 lands on a tag shoulder in the bore of housing 63 and causes load ring 73 to set in the same manner as upper casing hanger 53 (FIG. 6). A packoff assembly 79 secures to the upper end of hanger 71. Assembly 79 remains with hanger 71 and has a seal assembly 81 that seals to wickers 83 formed in housing 63. Other types of adapters and sealing mechanisms are feasible.

The invention has significant advantages. The difference between the load shoulders in the housing and on the casing hanger reduces friction while setting. The reduction in friction allows the load shoulders to be oriented at larger angles relative to the axis to support larger axial loads. The load shoulder arrangement increases the load bearing capacity of the hanger and wellhead housing.

While the invention has been shown in only two of its forms, it should be apparent to those skilled in the art that it is not so limited but is susceptible to various changes without departing from the scope of the invention.

The invention claimed is:

1. A subsea wellhead assembly, comprising:

a housing having a bore comprising at least one generally upward facing load shoulder that inclines at a first angle relative to an axis of the bore;

a hanger that is adapted to be lowered into the housing, the hanger having at least one load shoulder that faces downward when disposed within the housing at a second angle relative to the axis of the bore, the second angle being less than the first angle; and a split load ring having an inner profile that is adapted to slidingly engage the at least one load shoulder of the hanger and an outer profile that is adapted to slidingly engage the at least one generally upward facing load shoulder of the housing, the split load ring being carried by the hanger for movement between a retracted position, wherein the outer profile of the split load ring is spaced radially inward from the at least one generally upward facing load shoulder of the housing, and an expanded position, wherein the outer profile of the split load ring is in engagement with the at least one generally upward facing load shoulder of the housing;

an upward facing tag shoulder formed in the bore of the housing; and an activation ring mounted to the hanger below the load ring, the activation ring having a downward facing tag shoulder that engages the upward facing tag shoulder while the hanger is being lowered into the well, stopping downward movement of the activation ring and the load ring, the continued downward movement of the hanger causing the load ring to move from the retracted position to the expanded position.

2. The assembly according to claim 1, wherein the upward facing load shoulder has a lesser radial width than the downward facing load shoulder.

3. The assembly according to claim 1, further comprising:

a cylindrical housing stop surface adjoining the upward facing load shoulder; and a cylindrical load ring stop surface adjoining the outer profile; and wherein the load ring stop surface contacts the housing stop surface while the load ring is in the expanded position.

4. The assembly according to claim 1, further comprising:

a retaining member that secures the activation ring to the hanger for movement therewith until the tag shoulders engage each other.

5. The assembly according to claim 1, wherein:

said at least one upward facing load shoulder comprises a plurality of upward facing load shoulders;

said at least one downward facing load shoulder comprises a plurality of downward facing load shoulders; and there are more upward facing load shoulders than downward facing load shoulders.

6. The assembly according to claim 1, further comprising:

a flowby passage extending vertically through the activation ring;

a flowby passage extending vertically through the load ring in vertical alignment with the flowby passage in the activation ring; and an anti-rotation member mounted to the hanger and in engagement with the activation ring and the load ring to prevent rotation relative to the hanger.

7. The assembly according to claim 1, further comprising:

a latch member that latches the activation ring to the hanger as the hanger moves downward relative to the activation ring, so that an upward pull on the hanger after the load ring has expanded is resisted by the engagement of the activation ring with the load ring.

8. The assembly according to claim 1, further comprising:

a flowby passage in a wall of the housing and extending from below the load ring to above the load ring.

9. A subsea wellhead assembly, comprising:

a housing having a bore containing a plurality of conical generally upward facing load shoulders;

a hanger that is lowered into the housing, the hanger having a plurality of downward facing load shoulders;

a split load ring having an inner profile that engages the downward facing load shoulders, the load ring being inward biased to a retracted position and carried by the hanger;

a tag shoulder in the bore of the housing below the upward facing load shoulders;

an activation ring mounted to the hanger below the load ring for contact with the tag shoulder as the load ring is lowered into the housing;

the housing being movable downward relative to the activation ring after the activation ring lands on the tag shoulder, which causes the downward facing load shoulders to push the load ring outward to an expanded position, the load ring having an outer profile that engages the upward facing load shoulders in the housing when expanded;

the upward facing load shoulders in the housing incline at a first angle relative to an axis of the bore; and the downward facing load shoulders on the hanger incline at a second angle relative to the axis of the bore, the second angle being less than the first angle.

10. The assembly according to claim 9, wherein the upward facing load shoulders have a lesser radial width than the downward facing load shoulders.

11. The assembly according to claim 9, further comprising:

a cylindrical housing stop surface between two of the upward facing load shoulders on the housing;

a mating cylindrical load ring stop surface in the outer profile of the load ring; and wherein the load ring stop surface contacts the housing stop surface while the load ring is in the expanded position.

12. The assembly according to claim 9, further comprising:

a retaining member that secures the activation ring to the hanger for movement therewith until the activation ring lands on the tag shoulder.

13. The assembly according to claim 9, wherein:

there are more upward facing load shoulders than downward facing load shoulders.

14. The assembly according to claim 9, further comprising:

a flowby passage extending vertically through the activation ring;

a flowby passage extending vertically through the load ring in vertical alignment with the flowby passage in the activation ring; and an anti-rotation member mounted to the hanger and in engagement with the activation ring and the load ring to prevent rotation relative to the hanger.

15. The assembly according to claim 9, further comprising:

a latch member that latches the activation ring to the hanger as the hanger moves downward relative to the activation ring, so that an upward pull on the hanger after the load ring has expanded is resisted by the engagement of the activation ring with the load ring.

16. The assembly according to claim 9, further comprising:

a flowby passage in a wall of the housing and extending from below the load ring to above the load ring.

17. A subsea wellhead assembly, comprising:

a housing having a bore containing a plurality of conical generally upward facing load shoulders;

a hanger that is lowered into the housing, the hanger having a plurality of downward facing load shoulders;

a split load ring having an inner profile that engages the downward facing load shoulders, the load ring being inward biased to a retracted position and carried by the hanger;

a tag shoulder in the bore of the housing below the upward facing load shoulders;

an activation ring mounted to the hanger below the load ring for contact with the tag shoulder as the load ring is lowered into the housing;

the housing being movable downward relative to the activation ring after the activation ring lands on the tag shoulder, which causes the downward facing load shoulders to push the load ring outward to an expanded position, the load ring having an outer profile that engages the upward facing load shoulders in the housing when expanded;

a flowby passage extending vertically through the activation ring;

a flowby passage extending vertically through the load ring in vertical alignment with the flowby passage in the activation ring; and an anti-rotation member mounted to the hanger and in engagement with the activation ring and the load ring to prevent rotation relative to the hanger.

18. The assembly according to claim 17, wherein:

the upward facing load shoulders in the housing incline at a first angle relative to an axis of the bore; and the downward facing load shoulders on the hanger incline at a second angle relative to the axis of the bore, the second angle being less than the first angle.

19. The assembly according to claim 17, further comprising:

a cylindrical housing stop surface between two of the upward facing load shoulders on the housing;

a mating cylindrical load ring stop surface in the outer profile of the load ring; and wherein the load ring stop surface contacts the housing stop surface while the load ring is in the expanded position.

* * * * *